US007393080B2

(12) United States Patent
Ishikawa

(10) Patent No.: US 7,393,080 B2
(45) Date of Patent: Jul. 1, 2008

(54) IMAGE FORMING APPARATUS

(75) Inventor: Kazumasa Ishikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 350 days.

(21) Appl. No.: 11/222,185

(22) Filed: Sep. 8, 2005

(65) Prior Publication Data

US 2006/0055727 A1 Mar. 16, 2006

(30) Foreign Application Priority Data

Sep. 14, 2004 (JP) ..... 2004-266417

(51) Int. Cl.
*B41J 2/165* (2006.01)

(52) U.S. Cl. ..... 347/29; 347/30; 347/32

(58) Field of Classification Search ..... 347/22, 347/29, 30, 32
See application file for complete search history.

(56) References Cited

U.S. PATENT DOCUMENTS 5,896,143 A * 4/1999 Matsui et al. ..... 347/24

FOREIGN PATENT DOCUMENTS

| | | |
|---|---|---|
| JP | 2002-361905 | 12/2002 |
| JP | 2003-1832 | 1/2003 |
| JP | 2003-1839 | 1/2003 |

* cited by examiner

*Primary Examiner*—Shih-Wen Hsieh
(74) *Attorney, Agent, or Firm*—Cooper & Dunham, LLP

(57) ABSTRACT

An image forming apparatus includes a head part having a jet opening part configured to jet ink, a moisture retention cap configured to maintain moisture by covering the jet opening part, and a suction part configured to suction ink situated at the jet opening part. A suction cap having the suction part is provided separately from the moisture retention cap. The image forming apparatus includes a shutter member configured to open or close an opening part of the suction cap. The shutter member comes in contact with a perimeter of an edge part forming the opening part of the suction cap in a case where the shutter member is closed.

10 Claims, 8 Drawing Sheets

(A)

(B)

IMAGE FORMING APPARATUS

BACKGROUND

1. Technical Field

The present disclosure generally relates to image forming apparatuses, and more specifically an image forming apparatus including a head part having a jet opening configured to jet ink, a moisture retention cap configured to maintain moisture by closing the jet opening part, and a suction part configured to suction ink situated at the jet opening part.

2. Description of the Related Art

An inkjet printer as an image forming apparatus which jets an ink drop from a jet opening part of a head part so as to form an image on a recording medium is well known. A water type ink composed of a pigment and a solvent wherein a wetting agent (humectant) and penetrating agent are included in water, is used as ink liquid for such an inkjet printer. In an inkjet printer using the ink liquid, ink viscosity is increased due to evaporation of the ink solvent at a head jet opening so that the jet opening is clogged up or closed due to the adhesion of dust and thereby an image is degraded. In order to solve such a problem, Japan Laid-Open Patent Application Publications No. 2002-361905, No. 2003-1839, and No. 2003-1832 suggest a structure where a cap member for capping a head at the time of non-image forming so that moisture of a head jet opening is maintained and a suction mechanism such as a suction pump, provided at the cap member, for suctioning dust adhered to the jet opening together with the ink are provided. Thus, it is possible to prevent the increase of ink velocity.

By capping the head jet opening, ink viscosity is prevented from being increased due to the evaporation of the ink solvent at the head jet opening so that the jet opening is prevented from being clogged up. In addition, the dust adhered to the jet opening is suctioned together with the ink by the suction pump, so that the jet opening is prevented from being closed.

However, in the above-mentioned related arts disclosures, the ink suctioned by the suction pump is adhered to an internal wall surface of the cap member. Thus, if the head is capped in a state where the ink is adhered to the internal wall surface, the viscosity at the head jet opening is increased while the head jet opening is capped by the cap member. This causes an evaporation component such as water of the ink drop adhered to the internal wall surface of the cap member to evaporate when the cap member is opened, so that the ink drop, wherein the evaporation component adhered to the internal wall surface of the cap member evaporates, absorbs the evaporation component situated at the ink jet opening. As a result of this, the viscosity at the head jet opening is increased. Particularly, in a case where the ink liquid has a high viscosity, the image is influenced even if the viscosity at the head jet opening is slightly increased. Because of this, preliminary jetting is performed in order to adjust the viscosity of the jet opening and ink meniscus before printing starts. However, in order to adjust the viscosity of the jet opening, it is necessary to jet a lot of ink drops. Because of this, a lot of, from ten and several to several thousands, ink drops are jetted from a single jet opening for every preliminary jetting prior to start of the printing. This causes an increase in consumption of the ink.

The assignee of the present application suggests a structure where a moisture retention cap for maintaining moisture of the head jet opening and a suction cap for suctioning ink at the head jet opening are provided so that the viscosity of the ink is prevented from being increased at the time of moisture retention at the jet opening.

In a case where the moisture retention cap and the suction cap are separately provided, the suction cap is in a state where the suction cap is opened other than when the suction cap is suctioning the ink situated at the head jet opening. Because of this, a foreign body such as the dust enters into the suction cap and the dust is pulled into the suction tube and thereby it may not be possible to obtain a sufficient suction force due to closure of the flow path. In order to solve such a problem, a structure where a shutter member for covering an opening part of the suction cap at the time of non-operation of the suction means is provided is suggested at Japanese Patent Application No. 2004-184500. However, in the structure where the opening part of the suction cap is merely covered with the shutter member, a foreign body such as dust may enter into the suction cap via a gap between the opening part of the suction cap and the shutter member. Because of this, the dust may be pulled into the suction tube so that the flow path is closed and therefore sufficient suction force may not be obtained.

SUMMARY

The present disclosure provides an image forming apparatus whereby a foreign body such as dust can be prevented from coming into a suction cap so that a sufficient suction force is maintained for a long period of time.

The present disclosure provides an image forming apparatus, including:

a head part having a jet opening part configured to jet ink;

a moisture retention cap configured to maintain moisture by covering the jet opening part; and a suction part configured to suction ink situated at the jet opening part;

wherein a suction cap having the suction part is provided separately from the moisture retention cap;

the image forming apparatus includes a shutter member configured to open or close an opening part of the suction cap; and the shutter member comes in contact with a perimeter of an edge part forming the opening part of the suction cap in a case where the shutter member is closed.

The present disclosure provides an image forming apparatus, including:

a head part having a jet opening part configured to jet ink;

a moisture retention cap configured to maintain moisture by covering the jet opening part; and a suction part configured to suction ink situated at the jet opening part;

wherein a suction cap having the suction part is provided separately from the moisture retention cap;

the image forming apparatus includes shutter means for opening or closing an opening part of the suction cap; and the shutter means comes in contact with a perimeter of an edge part forming the opening part of the suction cap in a case where the shutter means is closed.

According to the above-mentioned gradation reproducing method, the suction cap configured to maintain the jet opening is provided separately from the moisture retention cap having the suction part configured to suction the ink situated at the jet opening part. Under this structure, ink is prevented from being adhered on an internal wall surface of the moisture retention cap and therefore viscosity of the ink is prevented from being increased at the time of maintaining moisture at the jet opening. The shutter member is provided so as to come in contact with the perimeter of the edge part forming the opening part of the suction cap in a case where the shutter member is closed. Under this structure, a foreign body such as dust is prevented from entering the suction cap and the dust is prevented from being pulled into a suction tube and thereby it is possible to avoid having an insufficient suction force due to closure of the flow path. As a result of this, a sufficient suction force can be maintained for a long period of time.

Other features and advantages will become more apparent from the following detailed description when read in conjunction with the accompanying drawings.

BRIEF DESCRIPTION OF THE DRAWINGS

FIG. 2-(*b*) is a bottom view of the carriage;

DETAILED DESCRIPTION OF PREFERRED EMBODIMENTS

A description of examples and exemplary embodiments of the present invention is now given, with reference to FIG. 1 through FIG. 11. An inkjet printer (hereinafter "printer") is discussed as an exemplary embodiment.

Figure 1:
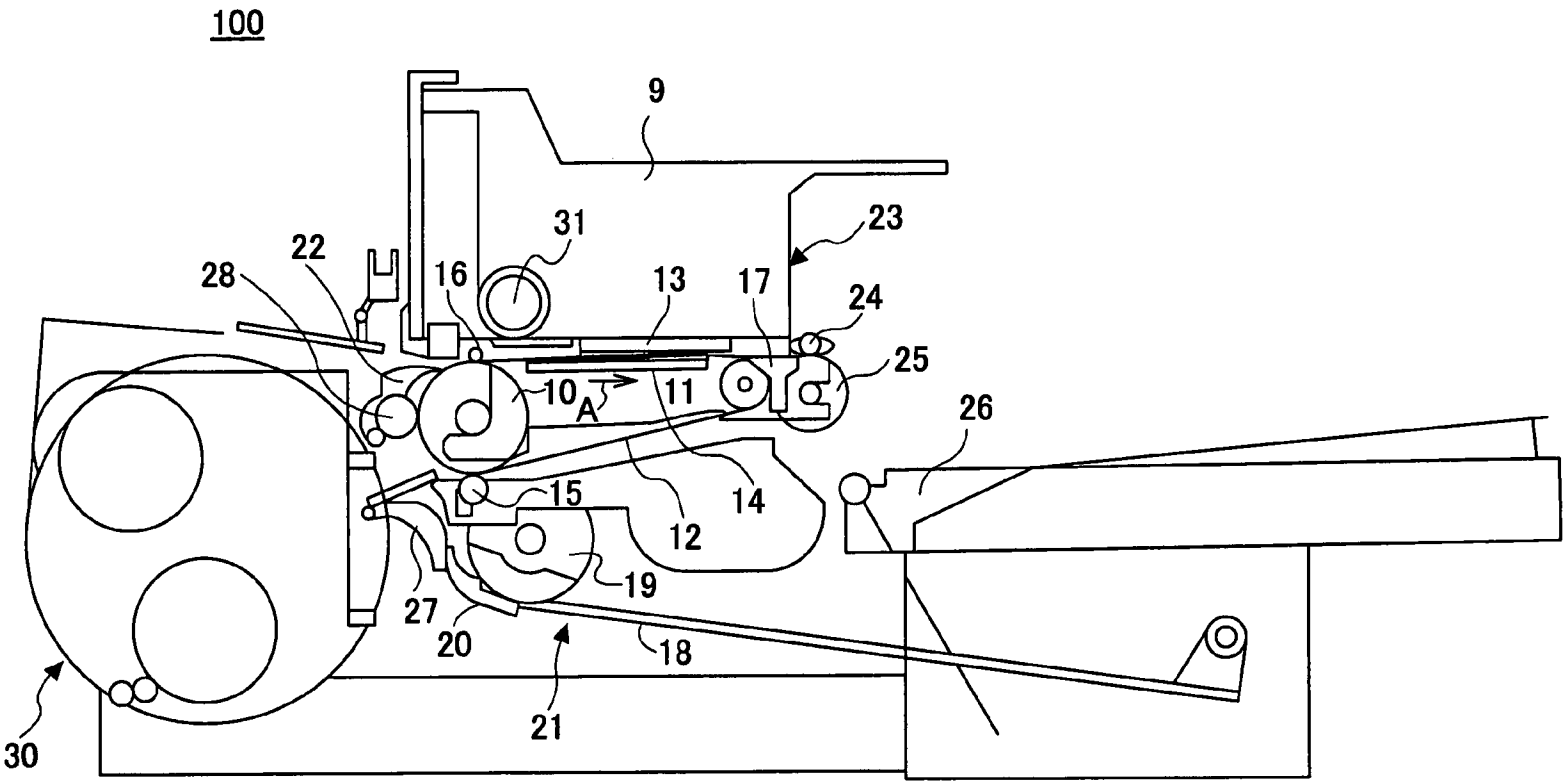
FIG. 1 is a front view showing a structure of an inkjet printer.

First, a basic structure of the printer is discussed. FIG. 1 is a front view showing an example of a structure of the inkjet printer.

A printer 100 includes a printing mechanism 23 having a carriage 9 movably held in a main scanning direction crossing a conveying direction of a paper by a driving part. The printer 100 includes a conveying part 21 conveying a paper situated in a paper feeding tray 18 to the paper discharge tray 26 via a position facing the printing mechanism 23.

Head 13 having plural jet openings for jetting ink liquid having colors of C (cyan), B (black), M (magenta), and Y (yellow) to the paper are provided in the carriage 9 of the printing mechanism 23.

The conveying part 21 includes the paper feeding tray 18, a paper feeding roller 19, a separation pad 20 and a paper feeding guide 27. A lot of papers are provided in the paper feeding tray 18. The paper situated in the paper feeding tray 18 is sent to the conveying roller 10 by the paper feeding roller 19. Only a single piece of paper among plural papers in the paper feeding tray 18 is sent to the conveying roller 10 by the separation pad 20. The paper fed from the paper feeding tray 18 is guided by the paper feeding guide 27. A conveying belt 12 is strained by the conveying roller 10 and a tension roller 11. The conveying roller 12 conveys the conveyed paper to a position facing the head 13. The conveying roller 10 is rotated clockwise by a driving part not shown in FIG. 1 so that the conveying belt 12 moves endlessly in a direction shown by an arrow A in FIG. 1. The conveying part 21 has a pressing roller 16 pressing the paper to the conveying roller 10, a guide 22 and a guide roller 28 which guide the paper, and a charging roller 15 for charging a surface the conveying belt 12. The guide 22 converts the direction of the paper conveyed upward in a substantially vertical direction, at approximately 90 degrees along a curvature of the conveying roller 10. Since the pressing roller 16 pushed the conveying belt 12 to the conveying roller 10, friction between the conveying belt 12 and the conveying roller 10 is increased. Because of this, the conveying belt 12 is prevented from sliding against the conveying roller 10 so that the paper can be conveyed with high precision. A conveying guide 14 guiding the conveying belt 12 is provided at the side of the internal circumferential surface of the conveying belt 12 opposing the head 13 face. The conveying part 21 has a separation claw 17 separating the paper where the image is recorded from the conveying belt 12, a paper discharge roller 25 discharging the paper to the paper discharging tray 26 and a spur 24 having a cross-section of a star-shaped configuration. The printer of this embodiment has a reverse mechanism 30 reversing a paper so that both surfaces of the paper can be printed.

Figure 2:
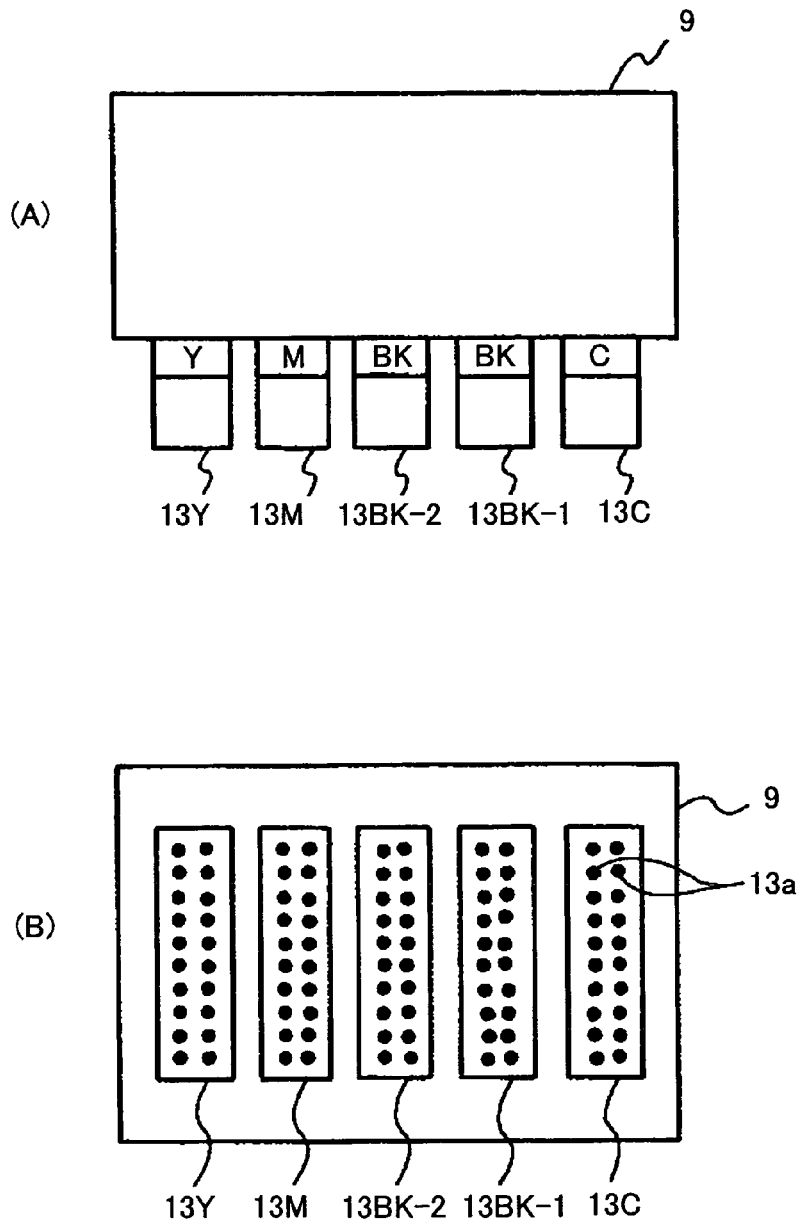
FIG. 2-(*a*) is a front view of a carriage.

FIG. 2-(*a*) is a front view of the carriage 9 and FIG. 2-(*b*) is a bottom view of the carriage 9. As shown in FIG. 2-(*a*), five heads 13C, 13Bk-1, 13Bk-2, 13M and 13Y (hereinafter "C", "Bk-1", "Bk-2", "M" and "Y") are provided in the carriage 9. As shown in FIG. 2-(*b*), 2 lines each of 192 pieces of the jet opening 13*a* are provided in the heads 13.

Figure 3:
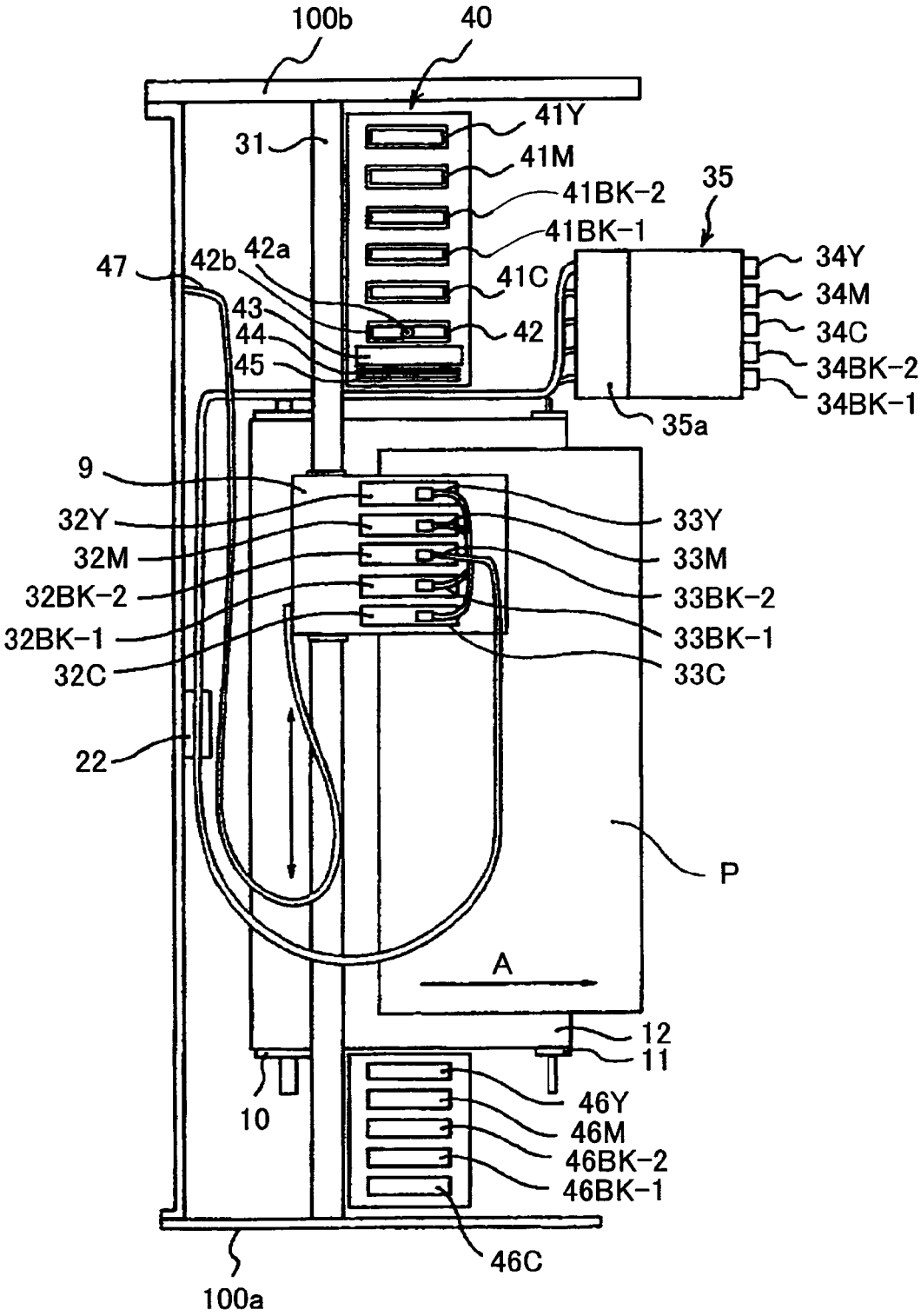
FIG. 3 is a plan view showing a structure of the inkjet printer.

FIG. 3 is a plan view showing a structure of the inkjet printer. As shown in FIG. 3, a guide rod 31 supporting the carriage 9 pierces the carriage 9 and is provided between main body side surfaces 100*a* and 100*b*. Furthermore, a carriage support member (not shown in FIG. 3) is provided so as to extend in parallel with the main guide rod 41 having a certain gap therebetween. The carriage 9 is supported by the main guide rod 41 and the carriage support member so as to move in parallel with in a main scanning line direction. The carriage 9 includes sub-tanks 32C, 32Bk-1, 32Bk-2, 32M, and 32Y (hereinafter "C", "Bk-1", "Bk-2", "M" and "Y") for supplying the ink liquid of respective colors to the heads 13C, 13Bk-1, 13Bk-2, 13M and 13Y. First ends of ink drop supplying tubes 33C, 33Bk-1, 33Bk-2, 33M and 33Y (hereinafter "C", "Bk-1", "Bk-2", "M" and "Y") corresponding to respective colors are connected to the respective sub-tanks 32C, 32Bk-1, 32Bk-2, 32M, and 32Y. The other ends of the ink drop supplying tubes 33 are connected to a supplying pump 35*a* of a cartridge filling part 35 where ink cartridges 34C, 34Bk-1, 34Bk-2, 34M, and 34Y (hereinafter "C", "Bk-1", "Bk-2", "M" and "Y") situated at a upper side in FIG. 3. The ink cartridges 34 are detachably installed to the cartridge filling part 35. The supplying pump 35*a* is properly driven so that the ink liquid in the ink cartridge 34 is supplied to the sub-tank 32 via the supplying tube 33. A harness 47 connecting a control part (not shown in FIG. 3) of the printer is provided in the carriage 9.

A recovering and retaining apparatus 40, having moisture retention caps 41C, 41Bk-1, 41Bk-2, 41M and 41Y (hereinafter "C", "Bk-1", "Bk-2", "M" and "Y") corresponding to respective the color heads 13C, 13Bk-1, 13Bk-2, 13M and 13Y and the suction cap 42, is provided at the upper side in FIG. 3, namely an end side in a main scanning direction of the conveying belt 12. The recovering and retaining apparatus 40 includes a first primary jet receiving part 43, a wiper blade 44 and a roller 45. The moisture retention cap 41 caps the jet opening 13*a* of the head 13 at the time of non-image forming so that the jet opening 13*a* is kept moist. In addition, a minute piercing hole connecting to the atmosphere is provided in the moisture retention cap 41 so that the moisture retention room is always kept at atmospheric pressure so that a meniscus of the jet opening 13*a* is kept constant. The suction cap 42 is provided at a side (a lower side in FIG. 3) closer to the printing area than the moisture retention cap 41. A suction hole 42*a* is provided in the suction cap 42. A suction part described below is provided at the suction hole 42*a*. The suction part of the suction cap 42 suctions air bubbles or dust adhered to the jet opening 13*a* together with the ink so that bad jetting can be avoided. The first primary jet receiving part 43 is provided, for example, so as to perform primary jetting prior to the start of recording, arrange the meniscus of the jet opening 13*a*, and keep a stable jet property. The wiper blade 44 cleans the ink liquid adhered to a surface having the jet opening 13*a* of the head 13. The roller 45 pushes the wiper blade 44 to the opening part of the first primary jet receiving part 43 so that a stain on the wiper blade 44 is removed by the opening part of the first primary jet receiving part 43. Respective moisture retention cap 41, the suction cap 42, the wiper blade 44, and the roller 45 can be moved upward and downward by a cam shaft described below. The details of the recovering and retaining apparatus 40 are discussed below.

Second primary jet receiving parts 46C, 46Bk-1, 46Bk-2, 46M, and 46Y corresponding to the respective color heads 13 are provided at a lower side in FIG. 3 of the conveying belt 12. The second primary jet receiving part 46 causes ink whose color is not used for image forming during the process of image forming to have the same viscosity as the ink whose color is used. More specifically, the ink whose color is not used for image forming during the process of image forming is jetted to the second primary jet receiving part 46 so that the same viscosity of the ink whose color is used can be maintained.

Next, a printing operation of the printer of this embodiment is discussed. A signal of image information is set from a personal computer so that a printing process is implemented. First, the paper is fed from the paper feeding tray 18 to the conveying roller 10 by the paper feeding roller 19. The paper fed from the paper feeding tray 18 is guided by the guide member 22 and the pressing roller 16 so as to be conveyed in a substantially vertical direction by the conveying belt 12. The surface of the conveying belt 12 is charged by the charging roller 15. The paper is attracted to and electrostatically adhered to the conveying belt 12. The paper adhered to the conveying belt 12 is guided by the guide 22 and the press roller so that the direction of the paper is changed by approximately 90 degrees so as to be conveyed in a horizontal state to a position facing the head 13. When the paper conveyed by the conveying belt 12 arrives at a position facing the head 13, the conveying belt 12 is stopped so that the movement of the paper is stopped. The carriage 9 is positioned on the recovering and retaining apparatus 40 shown in FIG. 3 prior to input of the image signal. This position is called a home position. Prior to the input of the image signal, the carriage 9 is positioned at the home position and the head 13 and the moisture retention cap 41 come in contact with each other, so that the jet opening 13 is in a state where the moisture is maintained. Based on the input of the image signal, the moisture retention cap 41 is lowered so that the carriage starts moving in a main scanning direction. Whenever the head 13 corresponding to the respective color is positioned in the first primary jet receiving part 43, the carriage 9 is stopped moving so that several ink drops are jetted to the first primary jet receiving part 43. After the primary jetting of the head 13 for each color is completed, moving of the carriage in a main scanning direction is restarted. Corresponding to the image signal, the carriage 9 is moved on the paper P in a main scanning direction. In addition, a designate ink liquid is jetted to a designated part of the paper P being stopped so that a single line of the image is formed on the paper P. A single line means a distance in a sub-scanning direction where the head 13 can record. After an image of a single line is formed, if necessary, the carriage 9 is moved to a position of the second primary jet receiving part 46 so that some ink drops of color not used in the image forming are jetted into the second primary jet receiving part 46. After a single line in a main scanning direction is completed being recorded on the paper P, the conveying belt 12 is driven for a designated time so that the paper P is moved in a direction of the paper discharge tray 26 by a single line and then stopped. After the moving of the conveying belt 12 is stopped, corresponding to the image signal, the carriage moves on the paper P in a main scanning direction so that a single line of the image is formed.

Such a process is repeated a designated number of times so that a desirable image is printed on the paper P. Thus, when the image is formed on the paper by repeated conveying and stopping of the paper P, since the paper is electrostatically adhered to the conveying belt 12, it is possible to stably convey the paper to a position facing the head 13. In addition, since the paper is pushed to the conveying belt 12 by the pressing roller 16, it is possible to securely electrostatically adhere the paper to the conveying belt 12. The paper where the desirable image is printed is separated from the conveying belt 12 by the separation claw 17, conveyed by the paper discharge roller 25 and the spur 24, and discharged to the paper discharge tray 26.

In a case where printing is performed for both surfaces of the paper, after a desirable image is printed on either surface of the paper, the rotation of the conveying belt 12 is reversed so that the paper is conveyed to the reversing mechanism 30. The paper reversed by the reversing mechanism 30 is guided to the guide member 22 or the pressing roller 26 again and conveyed by the conveying belt 12. After the paper arrives at a position facing the head part 13, the same operation is performed so that the desirable image is printed on other surface of the paper. The paper having both surfaces where the desirable images are printed is separated from the conveying belt 12 by the separation claw 17, conveyed by the paper discharge roller 25 and the spur 24, and discharged to the paper discharge tray 26.

After image forming is completed, the carriage 9 is moved again to the home position on the recovering and retaining apparatus 40. The moisture retention cap 41 is raised so that the moisture at the jet opening 13*a* of the head 13 is maintained.

The suction cap 42 is operated at the time of a cleaning mode. For example, a selection part such as a cleaning mode selection button is provided in the printer in advance. In a case where the user recognizes degradation of the image printed on the paper, the user selects the cleaning mode by the selection part so that the moisture retention cap 41 which maintains the moisture of the carriage 9 is lowered. The carriage 9 is moved so that the head 13C is positioned on the suction cap 42. After the head 13C is positioned on the suction cap 42, the carriage is stopped being moved. Then, the suction cap 42 is raised so as to come in contact with the head 13, and thereby the air bubble or the dust adhered to the jet opening 13*a* together with the ink are suctioned by the suction part. After the suction operation is completed, the suction cap 42 is lowered. At the same time when the suction cap 42 is lowered, the wiper blade 44 is raised. After the wiper blade 44 is raised, the carriage 9 is moved so that the head 13C slides against the wiper blade 44. By moving the carriage 9, the wiper blade 44 can remove an ink drop adhered due to sliding against the head 13C of color, C. After removing the ink drop situated at the head 13C, the wiper blade 44 is lowered. When the wiper blade 44 is lowered, the roller 45 is raised so that the wiper blade 44 is pushed to the opening part of the first primary jet receiving part 43. Under this structure, as the wiper blade 44 is lowered, the ink drop adhered to the wiper blade 44 is removed by the opening part of the primary jet receiving part 43 so that the wiper blade 44 is cleaned. As the wiper blade 44 is lowered, the carriage 9 is moved so that head 13C is positioned on the first primary jet receiving part 43 so that the primary jetting is performed by the first primary jet receiving part 43.

The above-discussed operation is done for other color heads 13Bk-1, 13Bk-2, 13M, and 13Y so that the bad jetting of the heads 13 is avoided and the ink drops adhered to the heads 13 can be removed.

Thus, in this embodiment, since the moisture retention cap and the suction cap are separately provided, the ink drop is not adhered to the suction cap. Hence, the ink viscosity at the jet opening 13*a* is prevented from increasing at the time of moisture retention. Because of this, it is not necessary to perform the primary jetting for arranging the ink viscosity at the primary jet prior to start of printing.

Although a case where the cleaning mode is selected by the user is discussed above, the cleaning mode may be implemented if the number of printing cycles a certain number, for example.

In addition, the suction operation is not limited to being performed at the time of the cleaning mode. For example, the suction operation may be implemented during an air opening filling mode.

Figure 4:
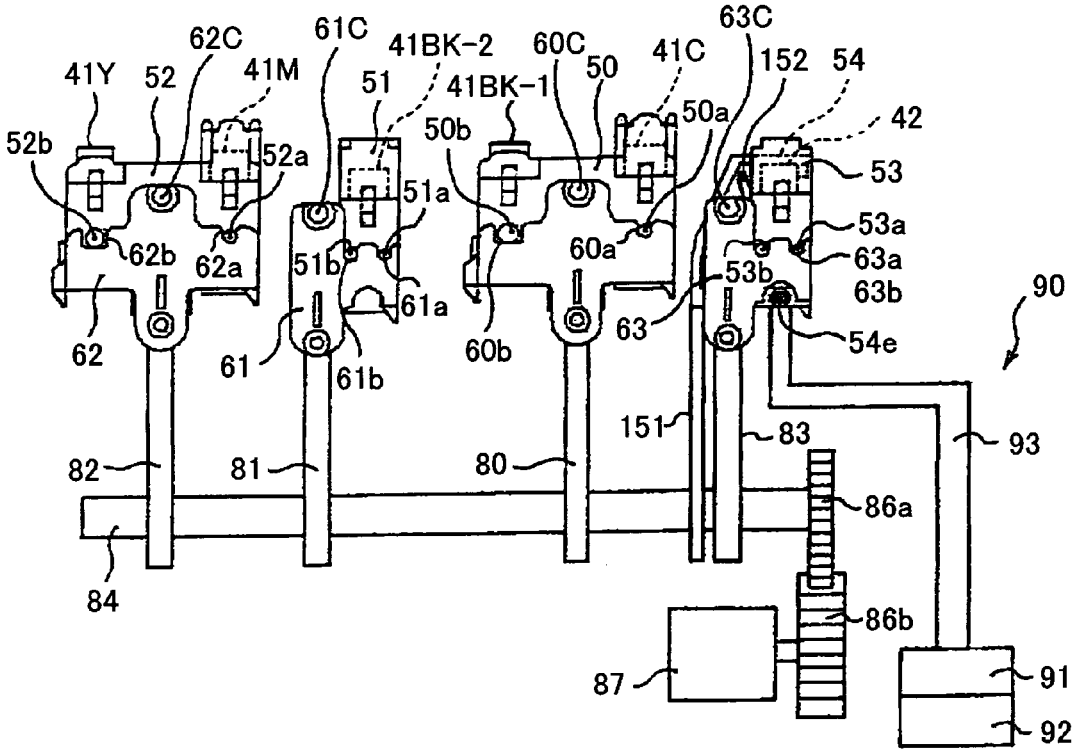
FIG. 4 is a side schematic view of a recovering and retaining apparatus 40.
Figure 5:
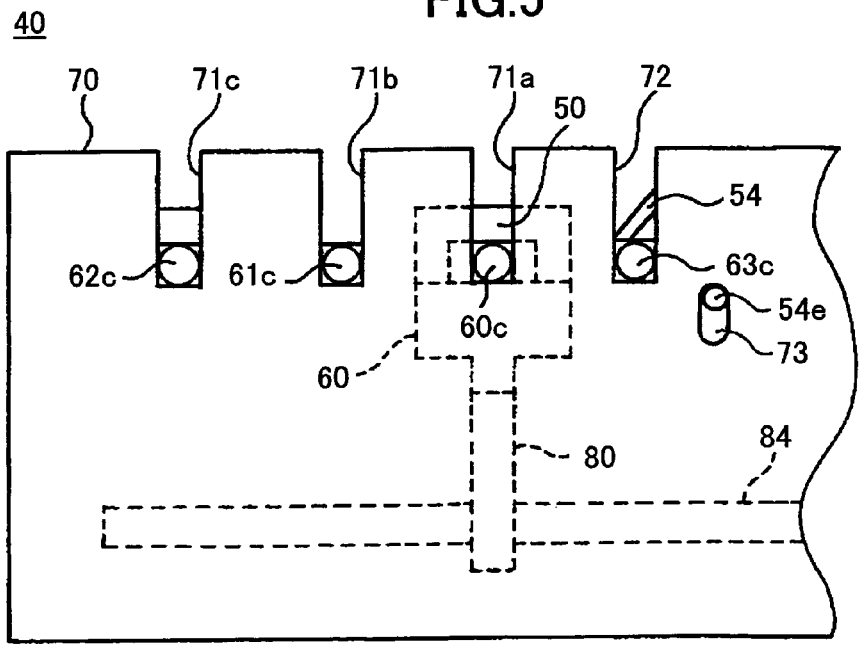
FIG. 5 is a view showing a frame of the recovering and retaining apparatus 40.

Next, the recovering and retaining apparatus 40 is discussed. First, the moisture retention cap 41 of the recovering and retaining apparatus 40 is discussed. FIG. 4 is a side schematic view of the recovering and retaining apparatus 40. As shown in FIG. 4, the moisture retention cap 41C capping the head 13C for color C and the moisture retention cap 41Bk-1 capping the head 13Bk-1 for color Bk-1 are held in the first holder 50. The moisture retention cap 41Bk-2 capping the head 13Bk-2 for color Bk-2 is held in the second holder 51. The moisture retention cap 41M capping the head 13M for color M and the moisture retention cap 41Y capping the head 13Y for color Y are held in the third holder 52. The first holder 50 is supported by the first slider 60. More specifically, as shown in FIG. 4, a first projection 50*a* and a second projection 50*b* respectively provided at a side surface of a front side and a side surface of a deep side of the first holder 50 are respectively supported by a first concave part 60*a* and a second concave part 60*b* respectively provided at a side surface of a front side and a side surface of a deep side of the first slider 60. Similarly, a first projection 51*a* and a second projection 51*b* respectively provided at a side surface of a front side and a side surface of a deep side of the second holder 51 are respectively supported by a first concave part 61*a* and a second concave part 61*b* respectively provided at a side surface of a front side and a side surface of a deep side of the second slider 61. Similarly, a first projection 52*a* and a second projection 52*b* respectively provided at a side surface of a front side and a side surface of a deep side of the third holder 52 are respectively supported by a first concave part 62*a* and a second concave part 62*b* respectively provided at a side surface of a front side and a side surface of a deep side of the third slider 62. The projections 60*c* are respectively provided at side surfaces of a front side and a deep side of the first slider 60. As shown in FIG. 5, the projections 60*c* are inserted into first notch parts 71*a* of the frame 70 of the recovering and retaining apparatus 40. The projections 61*c* provided on the side surface of the second slider 61 are inserted into second notch parts 71*b* of the frame 70 of the recovering and retaining apparatus 40. The projections 71*c* provided on the side surfaces of the front side and the deep side of the third slider 62 are inserted into third notch parts 71*c* of the frame 70 of the recovering and retaining apparatus 40.

As shown in FIG. 4, a first cam 80, a second cam 81 and a third cam 82 are respectively provided at the sliders 60, 61, and 62. The cams 80, 81 and 82 are fixed to a cam shaft 84. The cam shaft 84 is connected to a driving part 87 via a first gear 86*a* and a second gear 86*b*.

Figure 6:
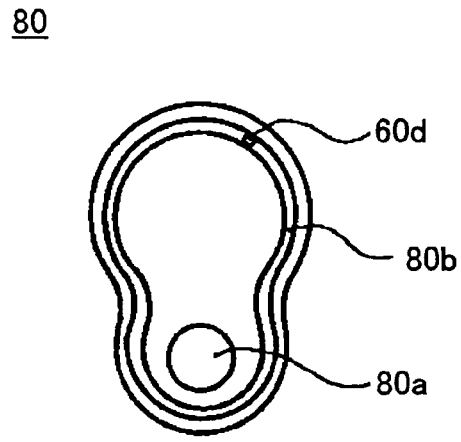
FIG. 6 is a schematic structural view of a first cam 80.

FIG. 6 is a schematic structural view of the first cam 80. Since other cams have substantially same structures, explanation thereof is omitted. The first cam 80 includes a hole 80*a* engaging with the cam shaft 84 and a cam groove 80*b* provided along a configuration of the cam 80. A cam pin 60*d* extending from the slider 60 is inserted into the cam groove 80*b*. As the cam shaft 84 is rotated, the cam 80 fixed to the cam shaft 84 is rotated so that the cam pin 60*d* relatively moves against the cam grove while the cam pin 60*d* is supported by the cam groove 80*b*. As a result of this, the first slider 60 is guided to the first notch part 71*a* shown in FIG. 5 so that the first slider 60 moves upward and downward. The moisture retention cap 41C for a color C and the moisture retention cap 41Bk-1 for a color Bk-1, which are supported by the first slider 60, move upward and downward.

The first cam 80, the second cam 81, and the third cam 82 are fixed to the cam shaft 84 while fixing angles are varied, so that the first cam 80, the second cam 81, and the third cam 82 move with time intervals and thereby torque can be decreased.

Next, the suction cap 42 of the recovering and retaining apparatus 40 is discussed. As shown in FIG. 4, the suction cap 42 is held by a suction cap holder 53. A first projection 53*a* and a second projection 53*b* situated at side surfaces of a front side and a deep side of the suction cap holder 53 are supported by a first concave part 63*a* and a second concave part 63*b* of the suction cap holder 53. The suction cap 42 has a shutter 54. In a state where the suction cap 42 is lowered as a normal operation, the shutter 54 is closed so that a foreign body such as dust may not enter into the suction cap 42.

Figure 7:
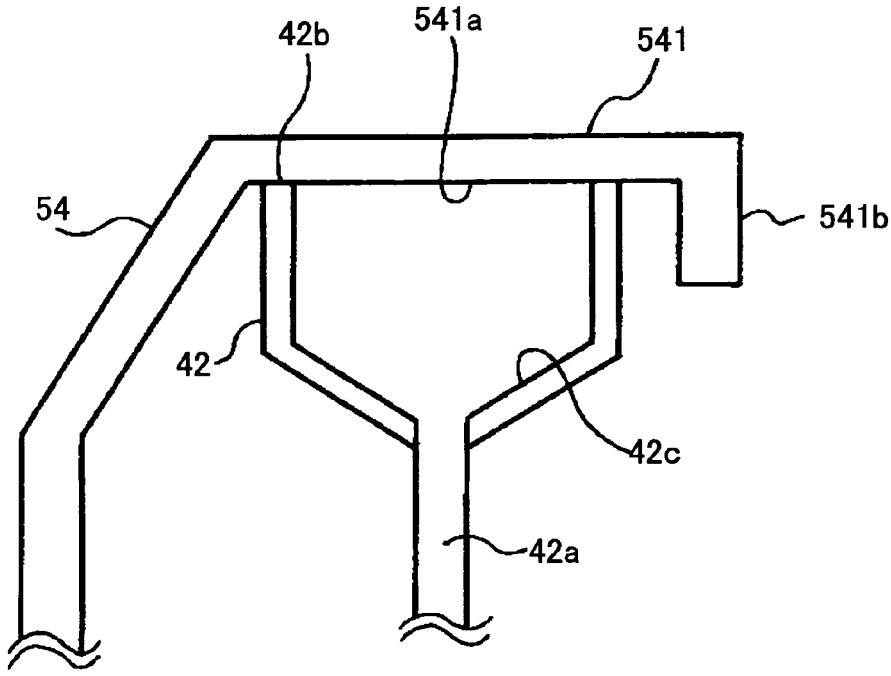
FIG. 7 is a cross-sectional view of a suction cap 42 in a state where a shutter 54 is closed.

FIG. 7 is a cross-sectional view of the suction cap 42 in a state where the shutter 54 is closed. As shown in FIG. 7, the suction cap 42 has a concave-shaped cross-section. A suction hole 42*a* is provided at the bottom surface of the concave part 42*c*. The shutter member 54 comes in contact with the edge part 42*b* forming the opening part of the suction cap 42.

As shown in FIG. 4, a shutter cam 151 is connected to a lower part of the shutter 54. The shutter cam 151 is fixed to the cam shaft 84 while an angle is formed by the shutter cam 151 and the suction cap cam 83.

Projections 63*c* are provided on side surfaces of the suction cap slider 63. As shown in FIG. 5, the projection 63*c* is supported by the suction cap notch part 72. As shown in FIG. 4, a suction part 90 composed of the suction tube 93 and the suction pump 91 is provided in the suction cap 42. The suction part 90 includes a waste tank 92 receiving the ink drop suctioned by the suction cap 42.

The cam pin 63*d* is provided at the suction cap slider 63. The cam pin 63*d* is inserted into a cam groove of the suction cap cam 83. The suction cap cam 83 is fixed to the cam shaft 84. The suction cap cam 83 has a substantially same structure as the first cam 80, the second cam 81, and the third cam 82. The suction cap cam 83 is fixed to the cam shaft 84 while the fixing angle is different from the first cam 80, the second cam 81 and the third cam 82. A rotation area of the cam shaft 84 where only the moisture retention cap 41 moves upward and downward, a rotation area of the cam shaft 84 where only the suction cap 42 moves upward and downward, and a rotation area of the cam shaft 84 where the moisture retention cap 41 and the suction cap 42 move upward and downward, are calculated. Based on the result of the calculation, the fixing angle of the suction cap cam 83 is determined.

By controlling a driving time of the driving part 87, only the moisture retention cap 41 moves upward and downward, only the suction cap 42 moves upward and downward, or the moisture retention cap 41 and the suction cap 42 move upward and downward.

Figure 8:
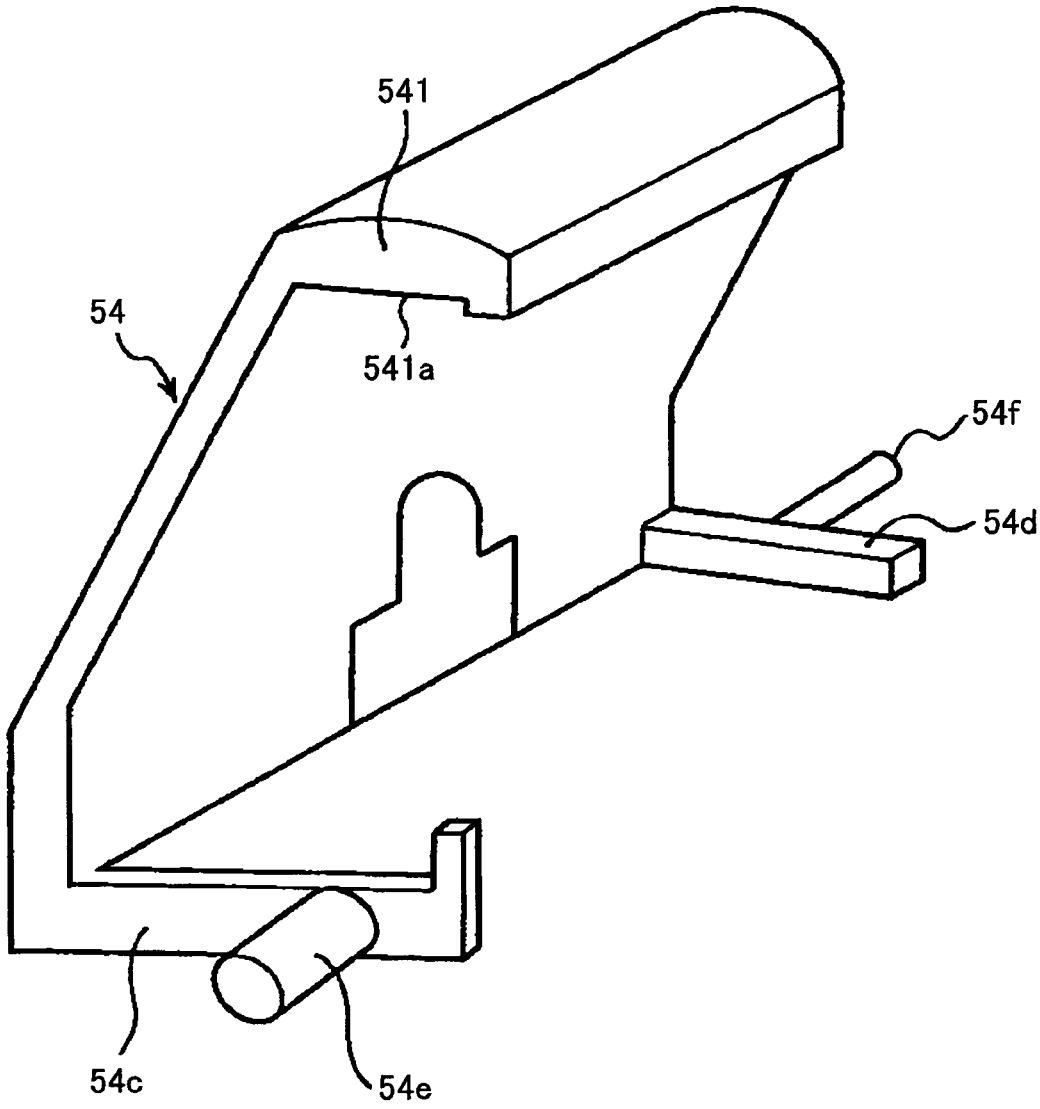
FIG. 8 is a perspective view showing the shutter 54.

FIG. 8 is a perspective view showing the shutter 54. The shutter 54 includes a shield part 541 having a cap contact surface 541*a* coming in contact with the edge part 42*b* of the suction cap 42 in a state where the suction cap 42 is lowered. Arm parts 54*c* and 54*d* are provided at deep and front sides of the shutter 54. Projections 54*e* and 54*f* are provided at external side surfaces of the arm parts 54*c* and 54*d*. As shown in FIG. 5, the projections 54*e* and 54*f* are rotatably supported by long hole parts 73 provided at front and deep side surfaces of the frame 70.

Figure 9:
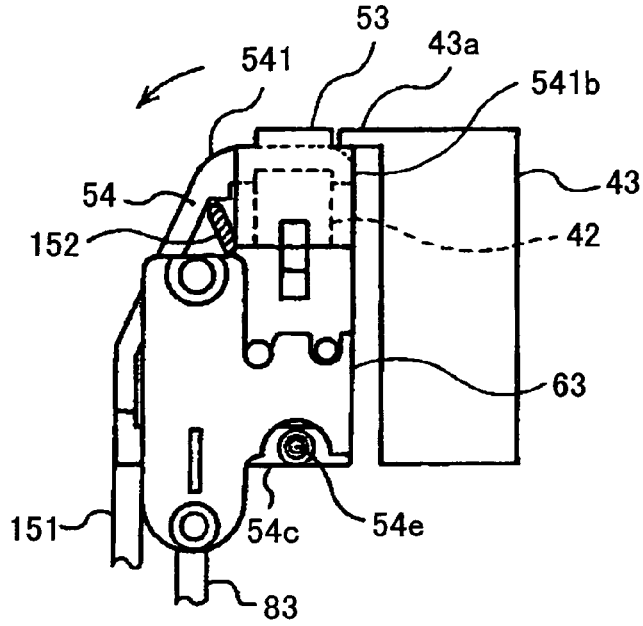
FIG. 9-(*a*) is a view showing a state where the shutter closes the suction cap and FIG. 9-(*b*) is a view showing a state where the shutter opens the suction cap.
Figure 9:
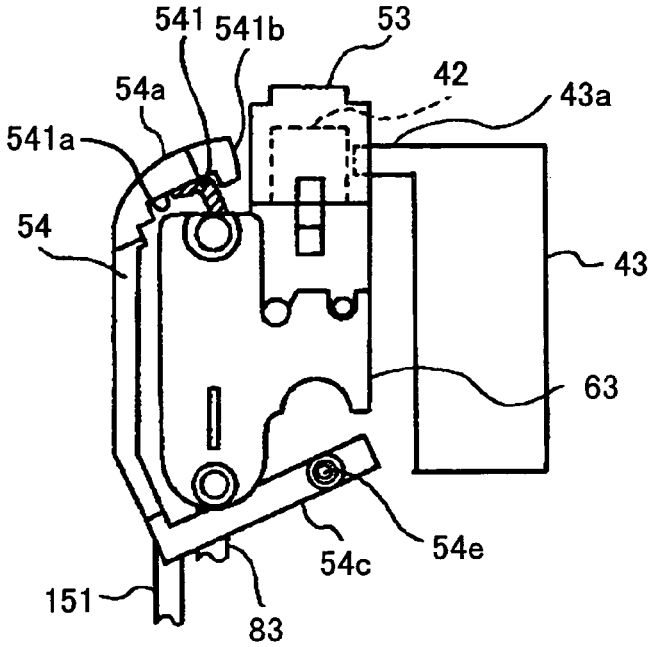

FIG. 9-(*a*) is a view showing a state where the suction cap 42 is at a receiving position and FIG. 9-(*b*) is a view showing a state where the suction cap 42 is at a suction position. As shown in FIG. 9-(*a*), the suction cap slider 63 includes a removing member 152 configured to come in contact with the cap contact surface 541*a* of the shield part 541 of the shutter 54 so as to remove the ink adhered to the cap contact surface 541*a*. The primary jet receiving part 43 includes a pushing member 43*a* configured to push the shield part 541 to a side of the suction cap 42 in a state where the edge part 42*b* of the suction cap 42 comes in contact with the cap contact surface 541*a* of the shield part 541. The pushing part 43*a* comes in contact with only the projection 541*b* projecting from the opening surface of the suction cap 42 in a state where the edge part 42*b* of the suction cap 42 comes in contact with the cap contact surface 541*a* of the shield part 541. The head end of the pushing part 43*a* is set to be a length so as to be not positioned on the opening part of the suction cap.

When the suction cap 42 is situated on the receiving position, the projection 54*e* of the shutter member is positioned, as shown in FIG. 5, on the upper part of the long hole part 73.

In a case where the suction operation is performed by the suction cap 24, the cam shaft 84 is driven so that the suction cap 42 together with the suction cap slider 63 are moved downward. Furthermore, the shutter 54 is also moved downward so that the shield part 541 is separated from the pushing part 43*a* of the primary jet receiving part 43. After the shield part 541 is separated from the pushing part 43*a*, as shown in FIG. 5, the shutter 54 and the suction cap slider 63 is moved downward until the projection 54*e* comes in contact with the lower part of the long hole part 73. After the projection 54*e* comes in contact with the lower part of the long hole part 73, the moving of the suction cap slider 63 is stopped. On the other hand, the shutter 54 is pulled downward by the shutter cam 151. As a result of this, the shutter 54 is rotated counterclockwise as shown by an arrow X in FIG. 9-(*a*) regarding the projections 54*f* and 54*e* so that the suction cap 42 is opened. After the suction cap 42 is opened, the suction cap 42 is moved upward together with the suction cap slider 63 as shown in FIG. 9-(*b*). At this time, the pushing part 43*a* is not positioned on the opening surface of the suction cap 42 and therefore does not obstruct the upward moving of the suction cap 42. During the upward moving of the suction cap 42, the removing member 152 comes in contact with the cap contact surface 541*a* of the shield part 541. After the ink situated at the jet opening 13*a* of the head 13 is suctioned, the cam shaft 84 is driven again so that the shutter 54 is pushed upward by the shutter cam 151. At this time, the shutter 54 is rotated clockwise as shown by an arrow Y in FIG. 9-(*b*) regarding the projections 54*f* and 54*e*. The cap contact surface 541*a* of the shield part 541 slides and comes in contact with a removing member 152 so that the ink adhered to the contact surface 541*a* of the shield part 541 is removed. In addition, the projection 541*b* of the shield part 541 may come in contact with the side surface of the suction cap 42 while the ink situated at the contact surface 541*a* of the shield part 541 being removed by the removing member 152. In this case, the suction cap 42 is lowered together with the suction cap slider 63 to a position where the suction cap 42 does not come in contact with the end part 541*b* of the shield part 541. The length of the removing member 152 is arranged so that the removing member 152 does not come in contact with the contact surface 541*a* of the shield part 541 even if the suction cap 42 is lowered to a position where the suction cap 42 does not come in contact with the edge part 541*b* of the shield part 541. Thus, after the ink situated at the contact surface 541*a* of the shield part 541 is removed, the suction cap 42 is lowered together with the suction cap slider 63. After the suction cap b42 is lowered together with the suction cap slider 63, the shutter 54 is rotated and the shield part 541 is positioned above the suction cap 42. After that, the suction cap 42 is raised with the suction cap slider 63 so that the contact surface 541*a* of the shield part 541 comes in contact with the periphery of the edge part 42*b* forming the opening part of the suction cap 42. In a state where the contact surface 541*a* comes in contact with the edge part 42*b*, the shutter 54 and the suction cap 42 are arisen with the suction cap slider 63 so that the shield part 541 is pushed to the pushing member 43*a* as shown in FIG. 9-(*a*). Thus, the contact surface 541*a* of the shield part 541 can securely come in contact with the periphery of the edge part 42*b* forming the opening part of the suction cap 42.

In the above-discussed embodiment, the shutter 54 moves upward and downward in a state where the hole parts 73 supporting the projections 54*f* and 54*e* of the shutter 54 are used as long holes, so that the shield part 541 is pushed to the pushing part 43*a*. However, the present invention is not limited to this. For example, the primary jet receiving part 43 may move upward and downward so that the pushing member 43*a* comes in contact with the shield part 541. In a case where suction operations are done by the suction cap 42, first the primary jet receiving part 43 is moved upward so that the pushing part 43*a* is separated from the shield part 54. After the suction operation by the suction cap 42 and the removal of the ink situated at the shield part contact surface 541*a* are completed, the shield part contact surface 541*a* of the shutter 54 comes in contact with the edge part 42*b* of the suction cap. After the contact surface 541*a* comes in contact with the edge part 42*b* of the suction cap 42, the primary jet receiving part 43 is moved downward so that the pushing part 43*a* is pushed to the shield part 541 and the contact surface 541*a* of the shield part 541 comes in contact with the periphery of the edge part 42*b* forming the opening part of the suction cap 42.

Next, a modified example of the shutter 54 is discussed. The shutter 54 of this modified example is arranged in an area between the head and the suction cap and can be moved in parallel with the opening surface of the suction cap.

Figure 10:
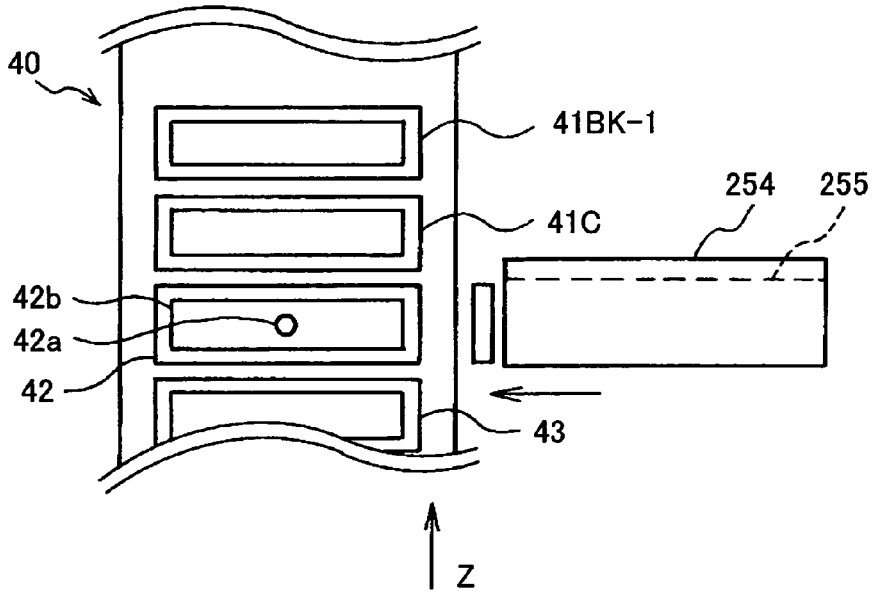
FIG. 10 is a schematic plan view showing a shutter of a modified example of the present invention.
Figure 11:
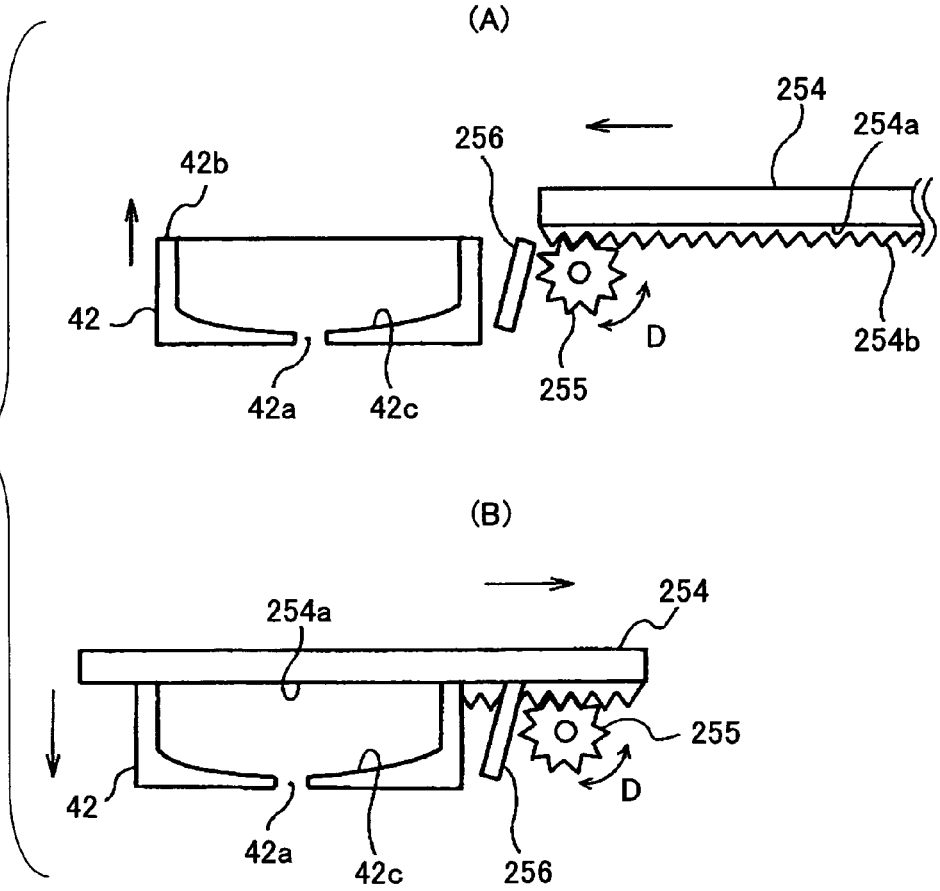
FIG. 11-(*a*) shows a state where the shutter of the modified example is opened and FIG. 11-(*b*) shows a state where the shutter is closed.

FIG. 10 is a schematic plan view showing a shutter 254 of a modified example of the present invention. FIG. 11 is a schematic cross-sectional view of the shutter 254 seen from a z direction of FIG. 10. FIG. 11-(*a*) shows a state where the shutter 254 is opened and FIG. 11-(*b*) shows a state where the shutter 254 is closed.

As shown in FIG. 11-(*a*), the length and width of the shutter 254 of the modified example is larger than the length and width of the suction cap. A rack 254*b* is provided at one end of the cap contact surface 254*a* of the shutter 254. A gear 255 is engaged with the rack 254*b* and a driving part not shown in FIG. 11 is provided at the gear 255. A removing member 256 slides and comes in contact with the cap contact surface 254*a* of the shutter 254.

At the time of normal operations, namely when the suction cap 42 is not being used, as shown in FIG. 11-(*b*), the contact surface 254*a* of the shutter 254 comes in contact with the periphery of the edge part 42*b* forming the opening part of the suction cap 42 so that the suction cap 42 is sealed. After the cleaning mode is implemented, the suction cap 42 is moved downward so that the suction cap 42 is separated from the shutter 254. After that, a driving part not shown in FIG. 11 is driven so that the gear 255 is rotated clockwise as shown by an arrow D in FIG. 11. As a result of this, the shutter 254 moves to a right side via the rack 254*b* engaging with the gear 255. At this time, the removing member 256 slides and comes in contact with the cap contact surface 254*a* so that the ink situated at the cap contact surface 254*a* is removed. After the shutter 254 moves to a position shown in FIG. 11-(*a*), the carriage 9 is moved so that the head 13C is situated on the suction cap 42. After the head 13C is situated on the suction cap 42, the suction cap 42 is raised so as to come in contact with the head 13. After the suction cap 42 comes in contact with the head 13, the suction operation is started. After the suction operation is completed, the suction cap 42 is moved downward so as to be separated from the head 13C. After the suction cap 42 is separated from the head 13C, the carriage 9 is moved so that the head 13Bk-1 is situated on the suction cap 42. After the head 13Bk-1 is situated on the suction cap 42, the suction cap 42 is raised again so that the suction cap 42 comes in contact with the head 13Bk-1 and thereby the suction operation is started. After the suction operation is completed, the suction cap 42 is separated and the carriage 9 is moved so that next head 13Bk-2 is situated on the suction cap 42. After the cleaning operation is performed for all of the heads 13 by repeating the above-discussed operation, the suction cap 42 is lowered to a position shown in FIG. 11-(*a*). After that, the driving part is driven so that the gear 255 is rotated counter-clockwise as shown by an arrow D, and the shutter 254 is moved over the suction cap 42. After the shutter 254 is moved over the suction cap 42, the suction cap 42 is raised so that the cap contact surface 254*a* of the shutter 254 comes in contact with the edge part 42*b* of the suction cap 42 and thereby the suction cap 42 is sealed.

According to an image forming apparatus of the above-discussed embodiment of the present invention, the moisture retention cap 41 configured to maintain the moisture at the jet opening part and the suction cap 42 configured to suction the ink situated at the jet opening part are separately provided. Hence, the ink does not adhere to the internal wall surface of the moisture retention cap 41. Therefore, the ink situated on the internal wall surface does not take the evaporation component of the ink situated at the jet opening part in so that the viscosity of the ink situated at the jet opening part is prevented from being increased. As a result of this, it is not necessary to perform a primary jetting for adjusting the viscosity of the jet opening part prior to start of printing and therefore the amount of ink consumed can be reduced. Furthermore, the shutter 54 is provided so as to come in contact with the edge part 42*b* of the suction cap 42 in a case where the shutter member is closed. Because of this, a foreign body such as dust is prevented from entering the suction cap 42. As a result of this, the dust is prevented from being pulled into the suction tube 93 and thereby it is possible to avoid having an insufficient suction force due to closing of the flow path. As a result of this, a sufficient suction force can be maintained for a long period of time.

If the cap contact surface of the shutter where the ink is adhered comes in contact with the edge part 42*b* of the suction cap 42, the ink adhered to the cap contact surface may be adhered to the edge part 42*b* of the suction cap 42. As a result of this, the ink adhered to the edge part 42*n* of the suction cap may be adhered to the head 13 at the time when the opening surface of the suction cap 42 comes in contact with the head for suctioning operations, so that the head 13 may get dirty.

However, in this embodiment, a removing part configured to remove ink adhered to the suction can contact surface of the shutter is provided. Under this structure, the ink adhered to the cap contact surface can be prevented from being adhered to the edge part 42*b* of the suction cap. Because of this, the head 13 can be prevented from getting dirty by contacting the edge part 42*b* of the suction cap when the edge part 42*b* of the suction cap comes in contact with the head 13 for suctioning operations.

Furthermore, in this embodiment, the removing member comes in contact with a cap contact surface of the shutter at the time of the operation of opening or closing of the shutter so that the ink adhered on the contact surface of the shutter member is removed. Under this structure, it is possible to securely remove the ink from the cap contact surface.

In addition, the suction cap 42 is opened or closed by rotating the shutter 54. It may be difficult for the edge part 42*b* of the suction cap 42 and the contact surface 541*a* of the shutter 54 to be in parallel with each other on the suction cap 42. That is, even when the shutter 54 is slightly sifted from a contact position where the shutter 54 comes in contact with the suction cap 42, the suction cap 42 may not be in parallel with the cap contact surface 541*a* of the shutter 54. Furthermore, in a case where the suction cap 42 is raised so that the suction cap 42 comes in contact with the cap contact surface 541*a* of the shutter 54, the shutter 54 is pushed by the suction cap 42 and therefore the cap contact surface 541*a* of the shutter 54 cannot be in parallel with the edge part 42*b* of the suction cap 42. Thus, the suction cap 42 may be closed by the shutter in a state where the cap contact surface 541*a* of the shutter 54 is not parallel with the edge part 42*b* of the suction cap 42. As a result of this, a gap may be formed between the suction cap 42 and the cap contact surface 541*a* and a foreign body such as dust may enter through the gap.

However, in the modified example, the shutter 254 moves in parallel with the edge part 42*b* of the suction cap 42 so that the suction cap 42 is opened or closed. Therefore, even in a case where the cap contact surface 254*a* of the shutter 254 coming contact with the suction cap 42 is opened by the suction cap 42, it is possible to keep the cap contact surface 254*a* and the edge part 42*b* parallel to each other. Hence, the suction cap 42 is not be closed by the shutter 254 in a state where the cap contact surface 254*a* of the shutter and the edge part 42*b* of the suction cap 42 are in parallel each other. As a result of this, the cap contact surface 254*a* of the shutter 254 securely comes in contact with a periphery of the edge part 42*b* of the suction cap 42. Hence, a gap is not formed between the edge part 42*b* of the suction cap 42 and the cap contact surface 254*a* of the shutter 254 and thereby it is possible to prevent a foreign body such as dust from entering.

Furthermore, if the shutter does not have rigidity, when the suction cap is raised so as to come in contact with the contact surface of the shutter, the shutter may be deformed. The suction cap may be closed by the shutter in a state where the cap contact surface of the shutter is not parallel to the edge part 42*b* of the suction cap. As described above, when the suction cap 42 is raised so as to come in contact with the contact surface of the shutter 54, the shutter 54 is pushed by the suction cap 42, the shutter 54 is rotated, and it may be difficult for the edge part 42*b* of the suction cap 42 and the contact surface 541*a* of the shutter 54 to be in parallel with each other.

However, in this embodiment, the pushing member 43*a* is provided so as to push the shutter to a side of the suction cap 42 in a state where the edge part 42*b* of the suction cap 42 comes in contact with the shutter. Under this structure, it is possible to prevent the shutter from being deformed or rotated when the suction cap 42 is raised and comes in contact with the cap contact surface. Hence, the suction cap can be closed in a state where the cap contact surface of the shutter is in parallel with the edge part 42*b* of the suction cap 42. Because of this, the cap contact surface of the shutter can come in contact with the periphery of the edge part 42*b* of the suction cap 42. Hence, a gap is not formed between the edge part 42*b* of the suction cap 42 and the cap contact surface 254*a* of the shutter 254 and thereby it is possible to prevent a foreign body such as dust from entering.

Furthermore, in this embodiment, the pushing member is situated at a position where the pushing member does not obstruct moving of the suction cap when the suction cap moves. More specifically, in a state where the suction cap is closed by the shutter, the pushing member comes in contact with the projection part of the shutter projecting from the opening part of the suction cap so that the head end of the pushing member is not positioned at an upper part of the opening part of the suction cap. Thus, even if the shutter is opened at the time of suctioning and the suction cap moves upward, the pushing member does not come in contact with the suction cap and the pushing member does not obstruct upward movement of the suction cap.

The present invention is not limited to the above-discussed examples and exemplary embodiments, but variations and modifications may be made without departing from the scope of the present disclosure and the appended claims.

Although the inkjet printer is discussed as an example of the image forming apparatus of the present invention, the present invention is not limited to this. For example, the present invention can be applied to a copier, fax machine, or multiple function machine having a printer, fax machine and copier, having an image reading apparatus configured to read image information such as a scanner and forming an image on a recording paper based on an image read by the image reading apparatus.

This patent application is based on Japanese Priority Patent Application No. 2004-266417 filed on Sep. 14, 2004, the entire contents of which are hereby incorporated by reference.

What is claimed is:

1. An image forming apparatus, comprising:

a head part having a jet opening part configured to jet ink;

a moisture retention cap configured to maintain moisture by covering the jet opening part; and a suction part configured to suction ink situated at the jet opening part;

wherein a suction cap having the suction part is provided separately from the moisture retention cap;

the image forming apparatus includes a shutter member configured to open or close an opening part of the suction cap;

the shutter member comes in contact with a perimeter of an edge part forming the opening part of the suction cap in a case where the shutter member is closed; and a removing part configured to remove ink adhered to the shutter member.

2. The image forming apparatus as claimed in claim 1, wherein the removing part slides and comes in contact with a contact surface of the shutter member, the contact surface contacting the edge part of the suction cap, in the operation of opening or closing of the shutter member, so that the ink adhered on the contact surface of the shutter member is removed.

3. The image forming apparatus as claimed in claim 1, wherein the shutter member moves in parallel with an opening surface of the suction cap.

4. The image forming apparatus as claimed in claim 1, further comprising:

a pushing member configured to push the shutter member to a side of the suction cap in a state where the edge part of the suction cap comes in contact with the shutter member.

5. The image forming apparatus as claimed in claim 4, further comprising:

a moving part configured to move the suction cap;

wherein the pushing member is situated at a position where the pushing member does not obstruct moving of the suction cap when the suction cap moves.

6. An image forming apparatus, comprising:

a head part having a jet opening part configured to jet ink;

a moisture retention cap configured to maintain moisture by covering the jet opening part;

a suction part configured to suction ink situated at the jet opening part; and removing means for removing ink adhered to the shutter member, wherein a suction cap having the suction part is provided separately from the moisture retention cap;

the image forming apparatus includes shutter means for opening or closing an opening part of the suction cap; and the shutter means comes in contact with a perimeter of an edge part forming the opening part of the suction cap in a case where the shutter means is closed.

7. The image forming apparatus as claimed in claim 6, wherein the removing means slides and comes in contact with a contact surface of the shutter means, the contact surface contacting the edge part of the suction cap, in the operation of opening or closing of the shutter means, so that the ink adhered on the contact surface of the shutter means is removed.

8. The image forming apparatus as claimed in claim 6, wherein the shutter means moves in parallel with an opening surface of the suction cap.

9. The image forming apparatus as claimed in claim 6, further comprising:

pushing means for pushing the shutter means to a side of the suction cap in a state where the edge part of the suction cap comes in contact with the shutter means.

10. The image forming apparatus as claimed in claim 9, further comprising:

moving means for moving the suction cap;

wherein the pushing means is situated at a position where the pushing means does not obstruct moving of the suction cap when the suction cap moves.

* * * * *